US011319811B2

(12) United States Patent
Higashioka et al.

(10) Patent No.: US 11,319,811 B2
(45) Date of Patent: May 3, 2022

(54) INTERNAL GEAR PUMP

(71) Applicant: SUBARU CORPORATION, Tokyo (JP)

(72) Inventors: Hiroaki Higashioka, Tokyo (JP); Yoshiaki Yuzawa, Tokyo (JP); Kazuhiro Toen, Tokyo (JP); Yuichi Suzuki, Tokyo (JP); Takahiro Yamamoto, Tokyo (JP); Takato Ogasawara, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 16/915,101

(22) Filed: Jun. 29, 2020

(65) Prior Publication Data

US 2021/0095566 A1 Apr. 1, 2021

(30) Foreign Application Priority Data

Sep. 27, 2019 (JP) ..... JP2019-176482

(51) Int. Cl.

| | |
|---|---|
| ***F01C 1/10*** | (2006.01) |
| ***F04C 2/10*** | (2006.01) |
| ***F04C 2/08*** | (2006.01) |
| ***F04C 13/00*** | (2006.01) |

(52) U.S. Cl.

CPC ..... *F01C 1/104* (2013.01); *F01C 1/10* (2013.01); *F04C 2/084* (2013.01); *F04C 2/102* (2013.01); *F04C 2/103* (2013.01); *F04C 13/007* (2013.01); *F04C 2210/206* (2013.01)

(58) Field of Classification Search

CPC .. F01C 1/10; F01C 1/104; F04C 2/084; F04C 2/102; F04C 2/103; F04C 13/007; F04C 2210/206

See application file for complete search history.

(56) References Cited

U.S. PATENT DOCUMENTS

| | | | | |
|---|---|---|---|---|
| 2002/0054822 | A1* | 5/2002 | Watanabe | F04C 2/086 418/171 |
| 2011/0038746 | A1* | 2/2011 | Eisenmann | F04C 2/102 418/166 |
| 2013/0315770 | A1* | 11/2013 | Rhein | F04C 2/086 418/61.3 |
| 2015/0267701 | A1* | 9/2015 | Pippes | F01C 21/108 417/410.4 |
| 2019/0032653 | A1* | 1/2019 | Horie | F04C 2/102 |

FOREIGN PATENT DOCUMENTS

| | | |
|---|---|---|
| JP | 2018-105199 A | 7/2018 |

* cited by examiner

*Primary Examiner* — Audrey B. Walter
(74) *Attorney, Agent, or Firm* — McGinn I.P. Law Group, PLLC.

(57) ABSTRACT

An internal gear pump includes an outer rotor having internal teeth, an inner rotor rotatably disposed inside the outer rotor and having external teeth engaging with the internal teeth, and a pump housing. The pump housing includes: a holding recess rotatably holding the outer rotor and having a wall on which an outer peripheral face of the outer rotor is to slide; an inlet to take in a fluid into pump chambers defined between the inner rotor and the outer rotor; an outlet to discharge the fluid from the pump chambers; a case groove provided on the wall and to hold the fluid; and a joint groove provided on an upper land face defined between a trailing end of the inlet and a leading end of the outlet and on which the internal teeth and the external teeth are to slide.

20 Claims, 15 Drawing Sheets

INTERNAL GEAR PUMP

CROSS-REFERENCE TO RELATED APPLICATIONS

The present application claims priority from Japanese Patent Application No. 2019-176482 filed on Sep. 27, 2019, the entire contents of which are hereby incorporated by reference.

BACKGROUND

The technology relates to an internal gear pump used for circulating oil, particularly to a technical field of an internal gear pump performing a pumping operation on the basis of a change in volume of pump chambers defined by an outer rotor and an inner rotor.

A power mechanism, such as an engine or a transmission, generally uses lubricating oil to smooth the operation and protect the components. Such a power mechanism includes an oil pump of various kinds that supplies the oil to each component. Examples of various types of oil pumps include an internal gear pump having an inner rotor and an outer rotor that are arranged eccentric to each other. The inner rotor has external teeth, and the outer rotor has internal teeth. The external teeth of the inner rotor and the internal teeth of the outer rotor define a plurality of spaces (pump chambers) therebetween. The internal gear pump performs a pumping operation on the basis of a change in volume of the pump chambers. For example, the pump chamber takes in the oil when being brought into communication with an inlet path and to have a larger volume, and discharges the oil when being brought into communication with an outlet path to have a smaller volume.

Such an internal gear pump can take in air bubbles depending on an attitude or state of the vehicle, for example. Air bubbles taken into the pump chambers can prevent the hydraulic pressure from sufficiently increasing during a contraction process. This can cause a back-flow of the oil from the outlet port to the pump chamber brought into communication with the outlet port, resulting in an abnormally high pressure spike and increased pressure pulsation. To address such a concern, Japanese Unexamined Patent Application Publication (JP-A) No. 2018-105199 discloses an oil pump having an outer peripheral groove provided on an inner peripheral face of a casing, and a radial groove provided on an outer rotor.

SUMMARY

An aspect of the technology provides an internal gear pump including an outer rotor, an inner rotor, and a pump housing. The outer rotor has internal teeth. The inner rotor is rotatably disposed inside the outer rotor and has external teeth engaging with the internal teeth. The external teeth are less in number by one than the internal teeth. The inner rotor and the outer rotor define a plurality of pump chambers therebetween. The pump chambers are configured to alternately repeat expansion and contraction. The pump housing includes a holding recess rotatably holding the outer rotor and having a wall on which an outer peripheral face of the outer rotor is to slide; an inlet configured to take in a fluid into the pump chambers; an outlet configured to discharge the fluid from the pump chambers; a case groove provided on the wall and configured to hold the fluid; and a joint groove provided on an upper land face that is defined between a trailing end of the inlet and a leading end of the outlet and on which the internal teeth and the external teeth are to slide. The joint groove joins the outlet and the case groove. The outer rotor further has rotor grooves configured to join the respective pump chambers to the case groove.

BRIEF DESCRIPTION OF THE DRAWINGS

The accompanying drawings are included to provide a further understanding of the technology and are incorporated in and constitute a part of this specification. The drawings illustrate exemplary embodiments and, together with the specification, serve to explain the principles of the technology.

DETAILED DESCRIPTION

With a configuration disclosed in JP-A No. 2018-105199, it can be difficult to sufficiently supply oil from a pump chamber (a closed portion) to an outer peripheral groove via a radial groove.

It is desirable to provide an internal gear pump that suppresses a back-flow of oil from an outlet port to a pump chamber in a case where air bubbles are taken into the pump chamber, and thereby reduces the pressure pulsation.

Some example embodiments of the technology will now be described in detail with reference to the accompanying drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments that are not recited in a most-generic independent claim of the technology are optional and may be provided on an as-needed basis. The drawings are schematic and are not intended to be drawn to scale. Throughout the present specification and the drawings, elements having substantially the same function and configuration are denoted with the same numerals to avoid any redundant description.

An internal gear pump 1 according to an example embodiment of the technology will now be described with reference to the accompanying drawings. In the following description, upward and downward directions are defined along a rotary axis of the pump. The upward and downward directions are not intended for indicating the directions when in use or being mounted. These directions are mere directions for the purpose of illustration. The example embodiments of the technology should not be limited to these directions. Note that the following example embodiments are described as examples in which the internal gear pump 1 is applied to a power transmission mechanism (hereinafter simply referred to as a transmission) of a vehicle.

1. EXAMPLE CONFIGURATION OF INTERNAL GEAR PUMP

Figure 1:
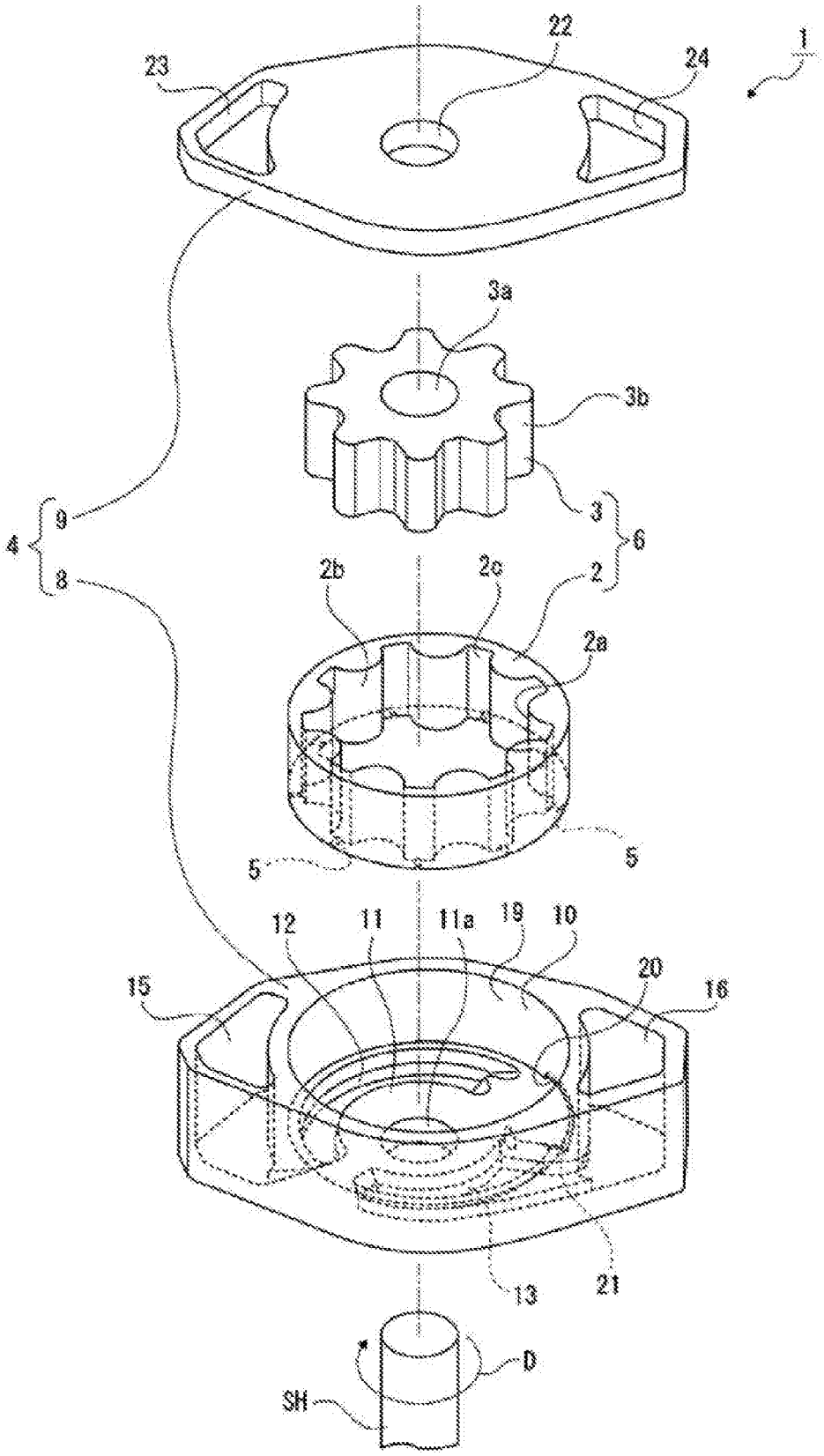
FIG. 1 is an exploded perspective view of an internal gear pump according to one example embodiment of the technology.

FIG. 1 is an exploded perspective view of the internal gear pump 1. The internal gear pump 1 includes an outer rotor 2, an inner rotor 3, and a pump housing 4. For example, the internal gear pump 1 may be a Trochoid Pump (Registered Trademark) or a Parachoid Pump (Registered Trademark).

The outer rotor 2 may have a cylinder shape with a through hole 2*a* vertically extending through the body of the outer rotor 2. The outer rotor 2 has internal teeth 2*b* that may be provided on an inner peripheral face of the outer rotor 2 defining the through hole 2*a*. In the example configuration illustrated in FIG. 1, the outer rotor 2 may have nine internal teeth 2*b*.

Figure 2:
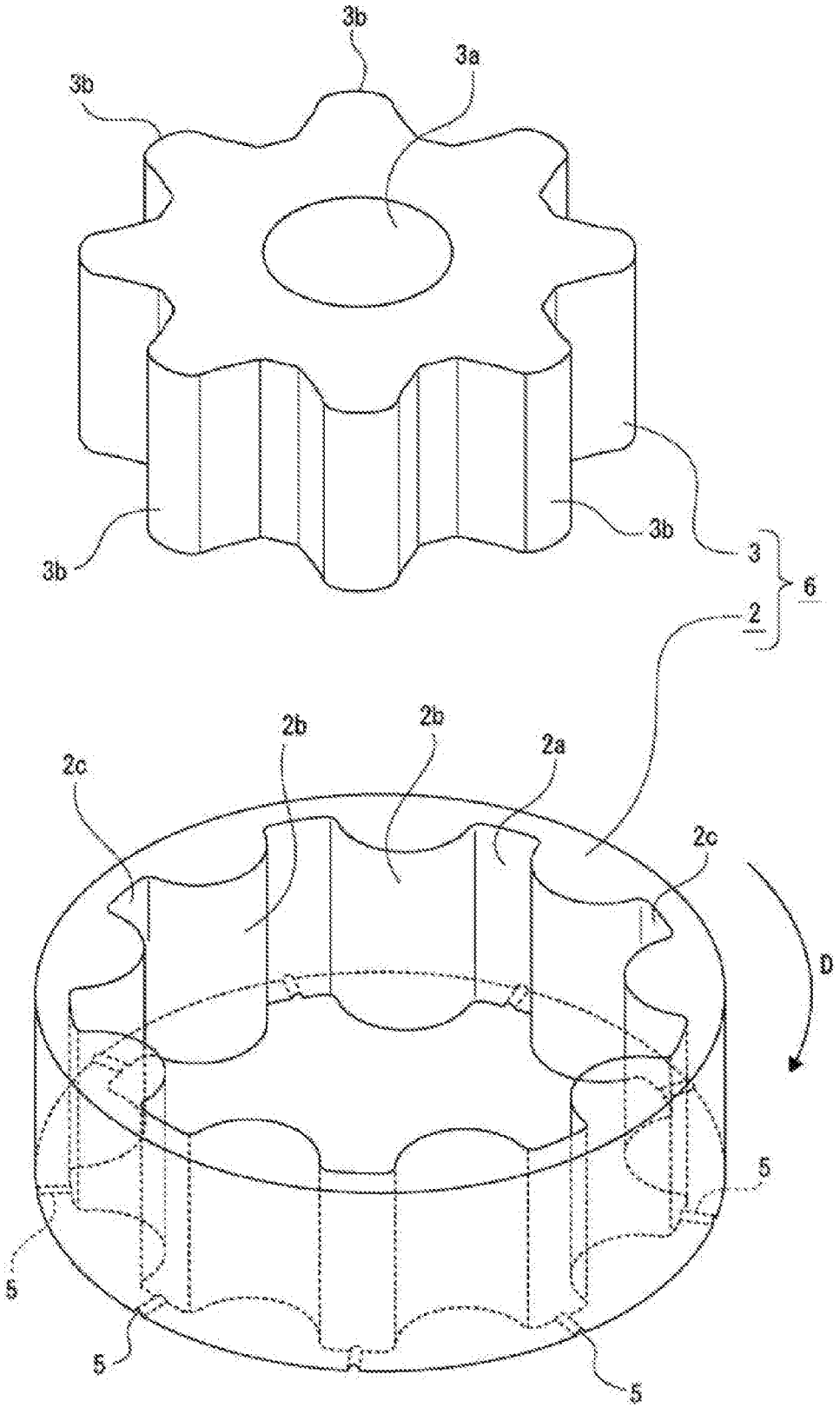
FIG. 2 is an exploded perspective view of a rotor unit of the internal gear pump.
Figure 3:
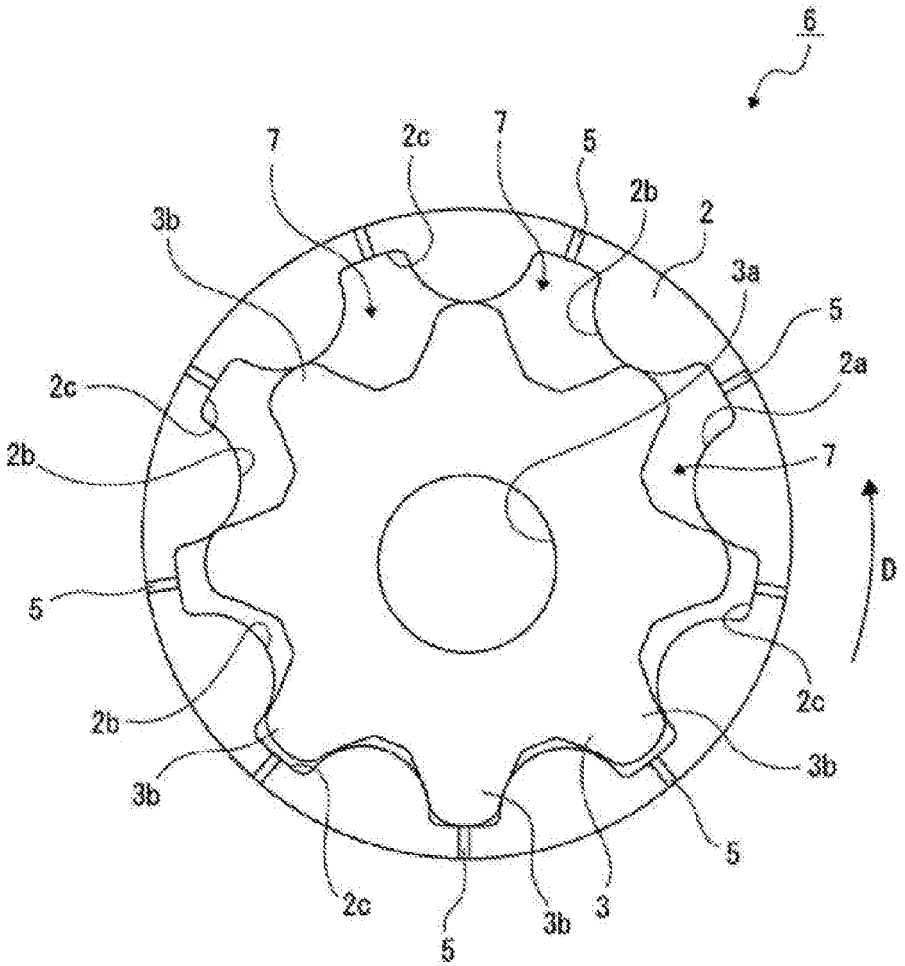
FIG. 3 is a bottom view of the rotor unit.

The outer rotor 2 may have rotor grooves 5 on its bottom face. The rotor grooves 5 may each extend from a tooth bottom 2*c* defined between two adjacent internal teeth 2*b* to the outer peripheral face of the outer rotor 2 in a radial direction of the outer rotor 2, as illustrated in FIGS. 2 and 3.

The inner rotor 3 may have a shaft hole 3*a* vertically extending through a central portion of the body of the inner rotor 3 and through which a pump shaft SH is inserted. The inner rotor 3 has external teeth 3*b* that may be continuously provided on the outer peripheral face in a circumferential direction of the inner rotor 3. The external teeth 3*b* engage with the internal teeth 2*b* of the outer rotor 2. The number of the external teeth 3*b* of the inner rotor 3 is less by one than that of the internal teeth 2*b* of the outer rotor 2. In the example configuration illustrated in FIG. 1, the inner rotor 3 may have eight external teeth 3*b*.

The inner rotor 3 may have non-illustrated protrusions and depressions on its inner peripheral face defining the shaft hole 3*a*. The protrusions and depressions may be engaged with depressions and protrusions provided on a peripheral face of the pump shaft SH. This configuration allow the inner rotor 3 to rotate around the rotary axis in accordance with rotation of the pump shaft SH. The pump shaft SH engaging with the protrusions and the depressions on the inner peripheral face defining the shaft hole 3*a* is prevented from running idle in the shaft hole 3*a*.

The inner rotor 3 may be disposed in the through hole 2*a* so as to be eccentric to the outer rotor 2. The outer rotor 2 and the inner rotor 3 may constitute a rotor unit 6.

FIGS. 2 and 3 illustrate the rotor unit 6 including the outer rotor 2 and the inner rotor 3. FIG. 2 illustrates the outer rotor 2 and the inner rotor 3 before being assembled. FIG. 3 is a bottom view of the rotor unit 6.

As illustrated in FIG. 3, the rotor unit 6 may have a plurality of pump chambers 7 defined between the outer rotor 2 and the inner rotor 3. The pump chambers 7 may be substantially individual spaces separated from each other by the internal teeth 2*b* of the outer rotor 2 and the external teeth 3*b* of the inner rotor 3.

The pump housing 4 has a case 8 and a cover 9 that may be vertically joined to each other, as illustrated in FIG. 1. The case 8 has a holding recess 10 that may have a cylindrical shape and opens upward. An inner peripheral face 19 of the case 8 defining the holding recess 10 may have substantially the same curvature as the outer peripheral face of the rotor unit 6. The rotor unit 6 may be rotatably held in the holding recess 10 with a slight clearance between the rotor unit 6 and the inner peripheral face 19 of the case 8.

Figure 4:
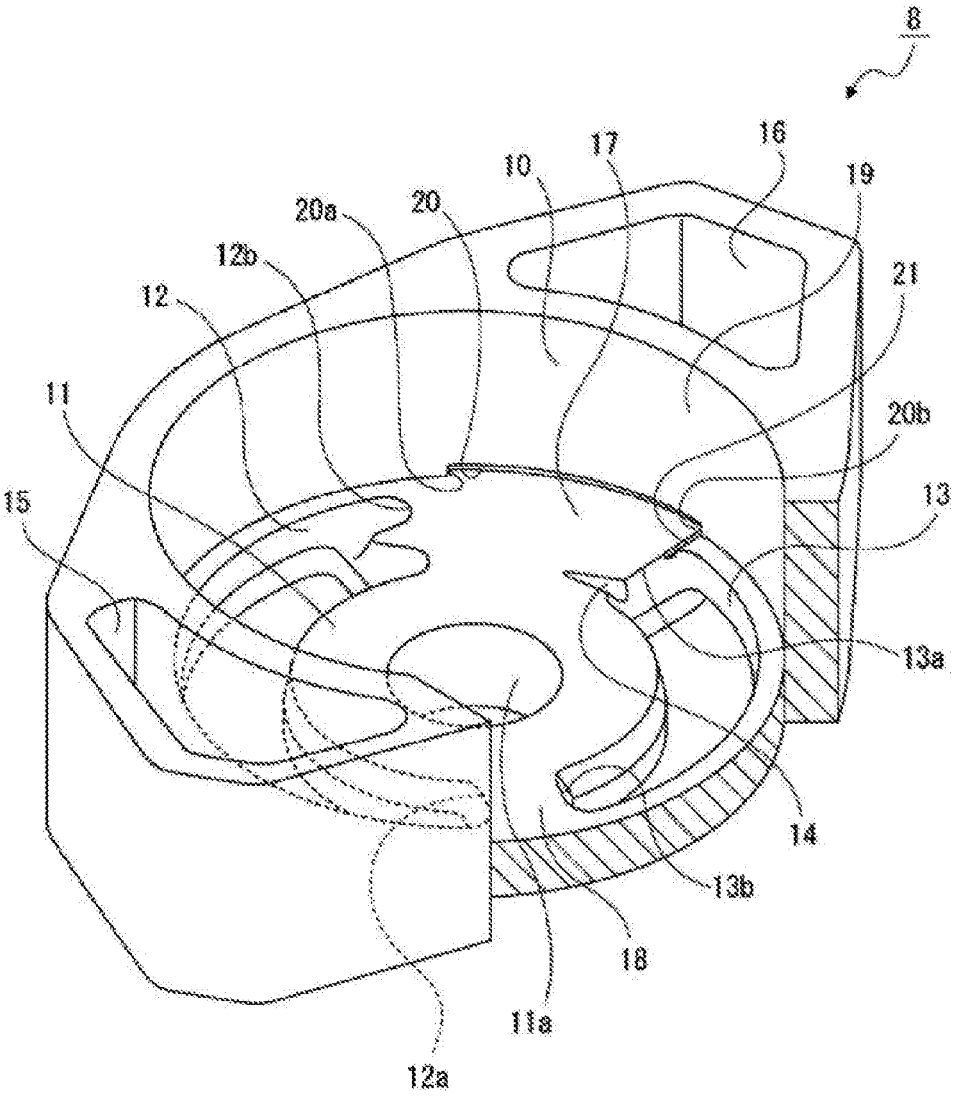
FIG. 4 is a perspective view of a case for the rotor unit with a part of the case being illustrated in a cross-sectional view.

The case 8 may have a bottom part 11 defining the holding recess 10. The bottom part 11 may have an insertion hole 11*a* at its central portion, as illustrated in FIG. 4. The pump shaft SH may be inserted in the insertion hole 11*a*.

The case 8 also has an inlet port 12 and an outlet port 13 provided in the bottom part 11. The inlet port 12 and the outlet port 13 may be provided along a circumferential edge of the insertion hole 11*a*. The inlet port 12 and the outlet port 13 may be provided at a distance in a circumferential direction of the holding recess 10. The inlet port 12 may open upward to guide oil into the pump chambers 7, and the outlet port 13 may open upward to discharge oil from the pump chambers 7. In one embodiment, the inlet port 12 may serve as an "inlet". In one embodiment, the outlet port 13 may serve as an "outlet".

The case 8 may have a grooved notch 14 on the bottom part 11. The grooved notch 14 may extend from a leading end 13*a* of the outlet port 13 towards the inlet port 12.

The case 8 may have a case-side inlet path 15 and a case-side outlet path 16 opposite to each other across the holding recess 10. The case-side inlet path 15 and the case-side outlet path 16 may open upward. The case-side inlet path 15 may be in communication with the inlet port 12 inside the case 8. The case-side outlet path 16 may be in communication with the outlet port 13 inside the case 8.

The case 8 may have an upper land face 17 and a lower land face 18. The upper land face 17 and the lower land face 18 may be defined between the inlet port 12 and the outlet port 13 of the bottom part 11. While the inner rotor 3 rotates around the pump shaft SH in association with rotation of the pump shaft SH, the pump chamber 7 passing over the inlet port 12 may pass over the upper land face 17 and then pass over the outlet port 13.

While the inner rotor 3 rotates around the pump shaft SH in association with rotation of the pump shaft SH, the pump chamber 7 passing over the outlet port 13 may pass over the lower land face 18 and then pass over the inlet port 12.

In the following description, the pump chamber 7 may advance in a rotational direction D around the rotary axis of the pump shaft SH.

The pump chamber 7 passing over the inlet port 12 may pass over the upper land face 17, the outlet port 13, and then the lower land face 18. During this movement, the pump chamber 7 may undergo a single cycle including a suction operation and a discharging operation.

In other words, the upper land face 17 is defined between a trailing end 12*b* of the inlet port 12 and the leading end 13*a* of the outlet port 13. The lower land face 18 may be defined between a trailing end 13*b* of the outlet port 13 and the leading end of 12*a* of the inlet port 12.

The case 8 also has a case groove 20 provided on the inner peripheral face 19 defining the holding recess 10. The case groove 20 may be provided at a corner defined by the upper land face 17 and the inner peripheral face 19 joined to each other. The case groove 20 may extend along the circumference of the inner peripheral face 19 and open toward the rotational center.

The case groove 20 may have a leading end 20*a* provided at a distance from the trailing end 12*b* of the inlet port 12 in the rotational direction D, and a trailing end 20*b* provided at the same position as the leading end 13*a* of the outlet port 13 in the rotational direction D. That is, the trailing end 20*b* of the case groove 20 and the leading end 13*a* of the outlet port 13 may be provided on an identical radial line of the outer rotor 2.

The case 8 also has a joint groove 21 radially extending from the leading end 13*a* of the outlet port 13 provided in the bottom part 11. The joint groove 21 joins the leading end 13*a* of the outlet port 13 and the trailing end 20*b* of the case groove 20.

The cover 9 may have an insertion hole 22 substantially at its center, as illustrated in FIG. 1. The cover 9 may also have a cover-side inlet path 23 and a cover-side outlet path 24 vertically extending through the body of the cover 9. The cover-side inlet path 23 and the cover-side outlet path 24 may be opposite to each other across the insertion hole 22.

The cover 9 may be joined to the case 8 accommodating the rotor unit 6 in the holding recess 10 so as to cover the top opening of the case 8. The pump shaft SH may be inserted through the insertion hole 11*a* of the case 8, the shaft hole 3*a* of the inner rotor 3, and the insertion hole 22 of the cover 9 joined to the case 8, and may be fixed in the shaft hole 3*a*.

Rotation of the inner rotor 3 in association with rotation of the pump shaft SH may repeatedly cause the external teeth 3*b* of the inner rotor 3 to alternately engage and disengage with the internal teeth 2*b* of the outer rotor 2. This imparts the rotational force of the inner rotor 3 to the outer rotor 2, causing the outer rotor 2 to rotate relative to the pump housing 4. The number of rotations of the outer rotor 2 may be different from that of the inner rotor 3 because the number of the internal teeth 2*b* of the outer rotor 2 is different from the number of the external teeth 3*b* of the inner rotor 3.

In the state where the cover 9 is joined to the case 8, the case-side inlet path 15 may be in communication with the cover-side inlet path 23 to form an inlet pathway to the pump chambers 7; and the case-side outlet path 16 may be in communication with the cover-side outlet path 24 to form an outlet pathway from the pump chambers 7.

In the state where the cover 9 is joined to the case 8, the pump chambers 7 may be closed spaces surrounded by the internal teeth 2*b* of the outer rotor 2, the external teeth 3*b* of the inner rotor 3, the bottom part 11 of the holding recess 10, and the lower face of the cover 9.

2. OPERATION OF INTERNAL GEAR PUMP

Figure 5:
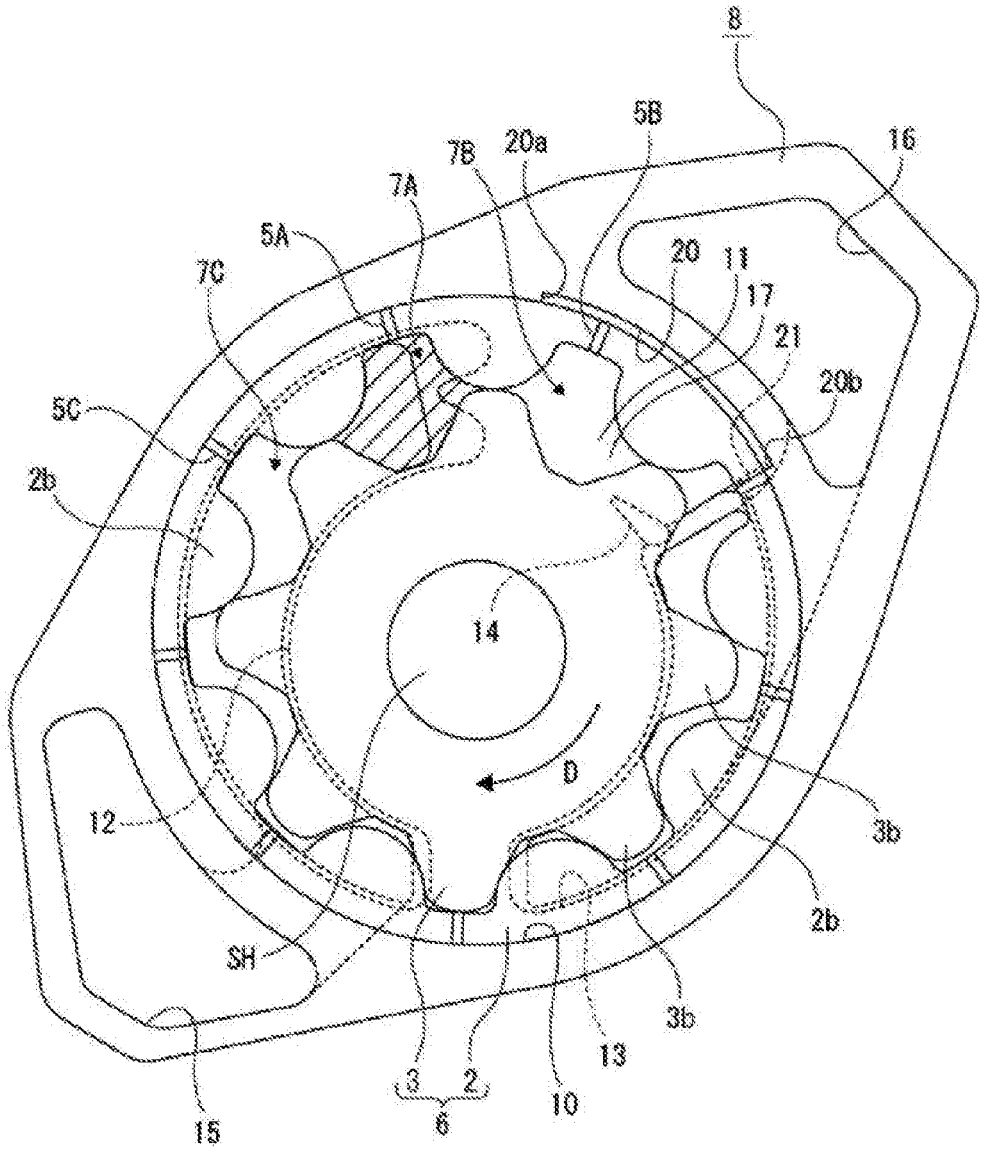
FIG. 5 is a top view of the rotor unit in the case for illustrating a movement of a pump chamber of interest.

An operation of the internal gear pump 1 according to an example embodiment will now be described with reference to FIGS. 5 to 15. FIG. 5 illustrates a top view of the outer rotor 2, the inner rotor 3, the pump shaft SH, and the case 8 seen through the top opening of the holding recess 10.

Rotating the pump shaft SH in the rotational direction D may cause the inner rotor 3 to rotate in the rotational direction D. When the inner rotor 3 is rotated, engagement between some of the internal teeth 2*b* of the outer rotor 2 and some of the external teeth 3*b* of the inner rotor 3 may impart a rotational force to the outer rotor 2, causing the outer rotor 2 to rotate in the rotational direction D.

In association with the rotation of the pump shaft SH, the inner rotor 3, and the outer rotor 2, the pump chambers 7 may move along the outer circumference of the inner rotor 3 while alternately repeating expansion and contraction. In association of the movement of the pump chambers 7, each of the pump chambers 7 may be appropriately brought into communication with the inlet port 12 and the outlet port 13 of the case 8 to make a pumping operation.

The following description focuses on a pump chamber 7A, which is one of the pump chambers 7, for describing how the pump chambers 7 expand or contract. The pump chamber 7A corresponds to a hatched region in FIG. 5 and the subsequent drawings. Additionally, one of the rotor grooves 5 radially extending from the pump chamber 7A toward outside the outer rotor 2 is described as a rotor groove 5A.

One of the pump chambers 7 adjacent to the pump chamber 7A in the rotational direction D (advancing direction) is referred to as a pump chamber 7B, and one of the rotor grooves 5 radially extending from the pump chamber 7B is referred to as a rotor groove 5B. Another pump chamber 7 adjacent to the pump chamber 7A in a direction opposite to the rotational direction D is referred to as a pump chamber 7C, and another rotor groove 5 radially extending from the pump chamber 7C is referred to as a rotor groove 5C.

FIG. 5 illustrates the pump chamber 7A in the process of expanding in volume: The pump chamber 7A is in communication with the inlet port 12 to take in oil from the inlet port 12. Further rotating the pump shaft SH may bring the pump chamber 7A in the state illustrated in FIG. 5 into a state illustrated in FIG. 6.

Figure 6:
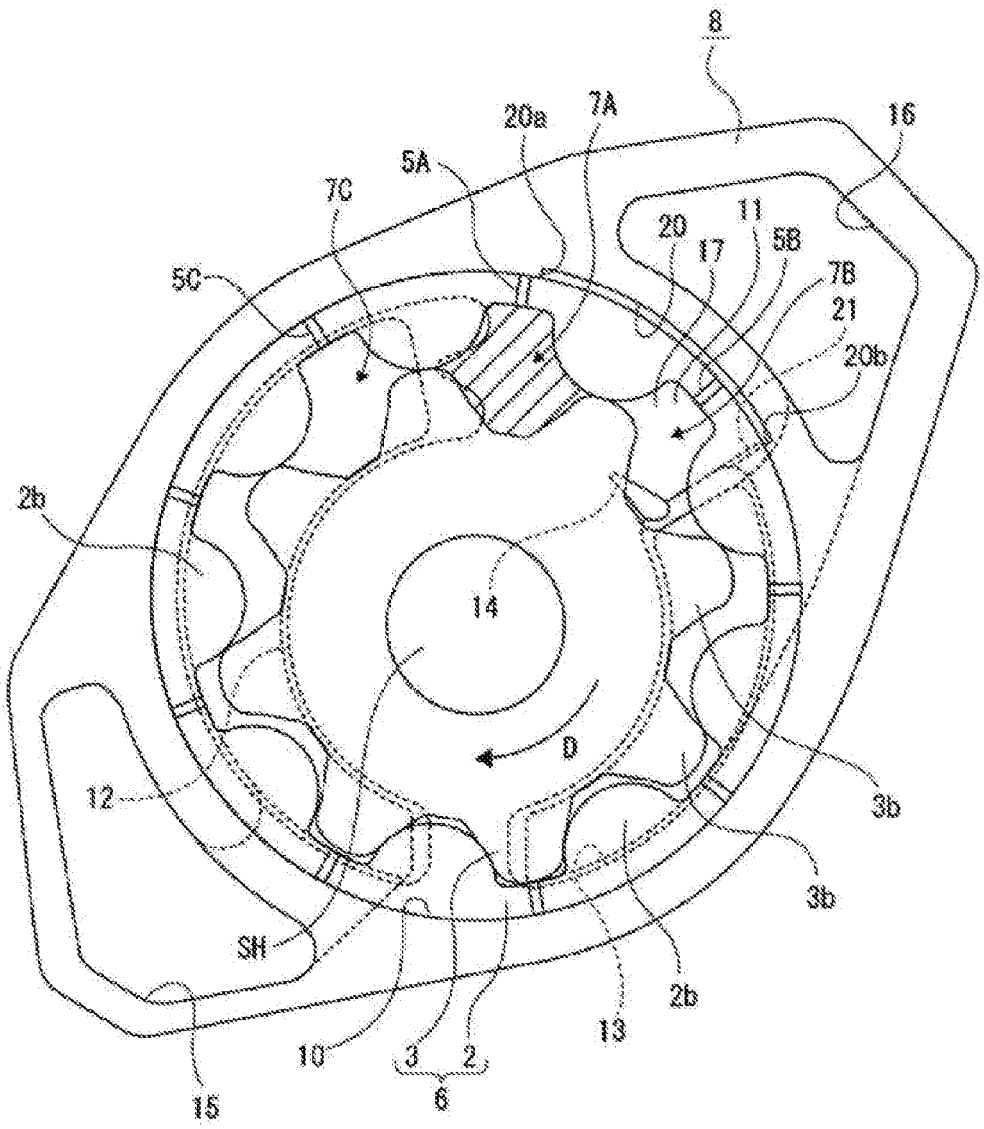
FIG. 6 is a top view of the rotor unit in the case for illustrating a movement of the pump chamber of interest.
Figure 7:
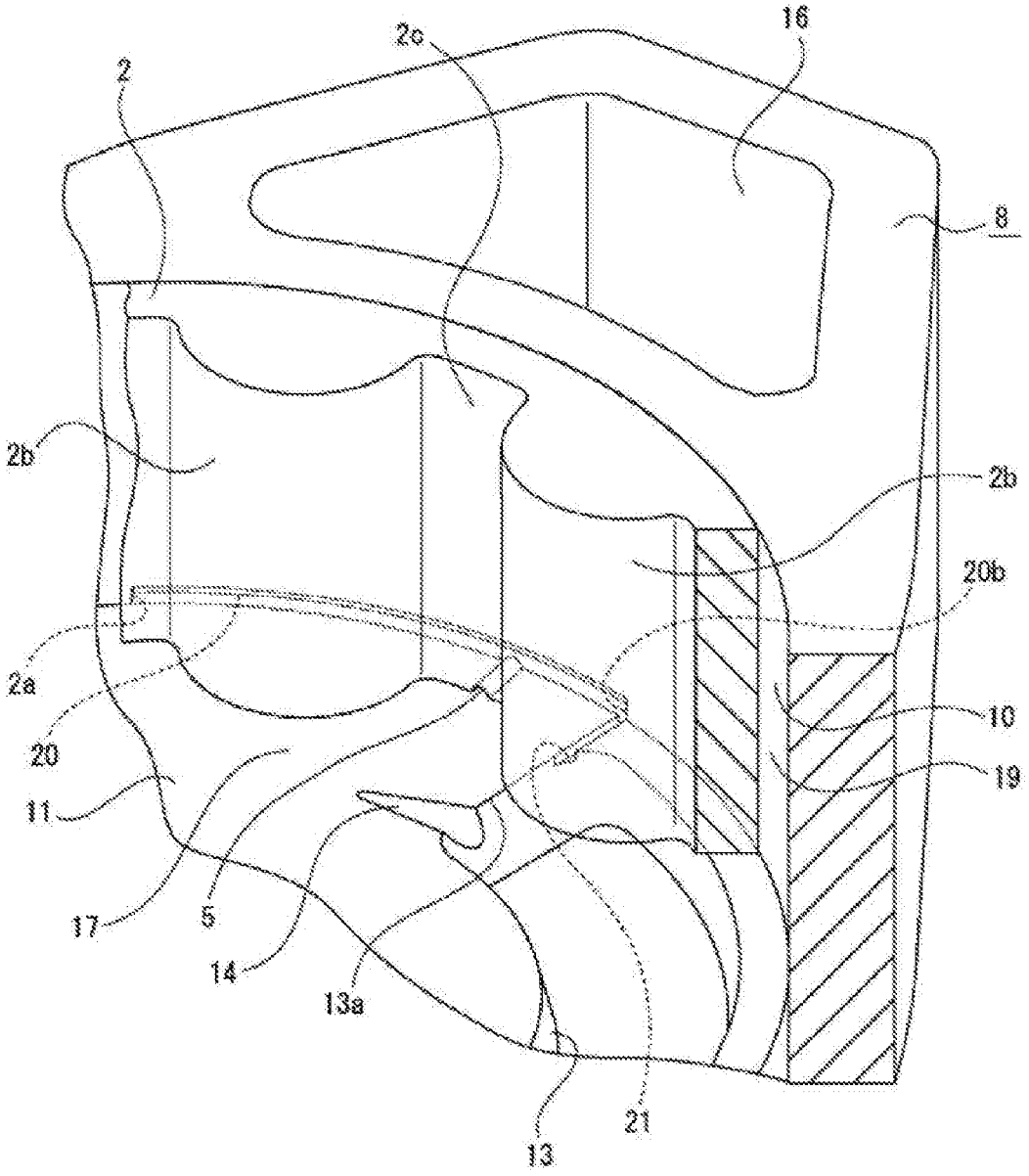
FIG. 7 is a perspective view of the case for illustrating a positional relation between a joint groove and internal teeth.

FIG. 6 illustrates the pump chamber 7A having passed over the inlet port 12 and coming to the end of the suction operation. In the state illustrated in FIG. 6, a large part of the pump chamber 7A may be located on the upper land face 17, and thus the pump chamber 7A may be in the process of being brought out of communication with the inlet port 12. FIG. 6 also illustrates the rotor groove 5A before being brought into communication with the case groove 20.

In the state illustrated in FIG. 6, the rotor groove 5B may be in communication with the case groove 20, and the outlet port 13 may be in communication with the case groove 20 via the joint groove 21. Accordingly, a part of the oil discharged from the pump chamber 7B in the process of the discharging operation may be flown via the rotor groove 5B into the case groove 20 and held in the case groove 20, and the oil discharged from the outlet port 13 may be flown into the case groove 20 via the joint groove 21 due to a differential pressure. In the state illustrated in FIGS. 6 and 7, the top opening of the joint groove 21 may be closed with the internal tooth 2*b* of the outer rotor 2 located above the joint groove 21. Thus, the outlet port 13 and the case groove 20 may be in communication with each other only via side openings of the joint groove 21. This reduces the amount of the oil to be flown into the case groove 20 via the joint groove 21.

Figure 8:
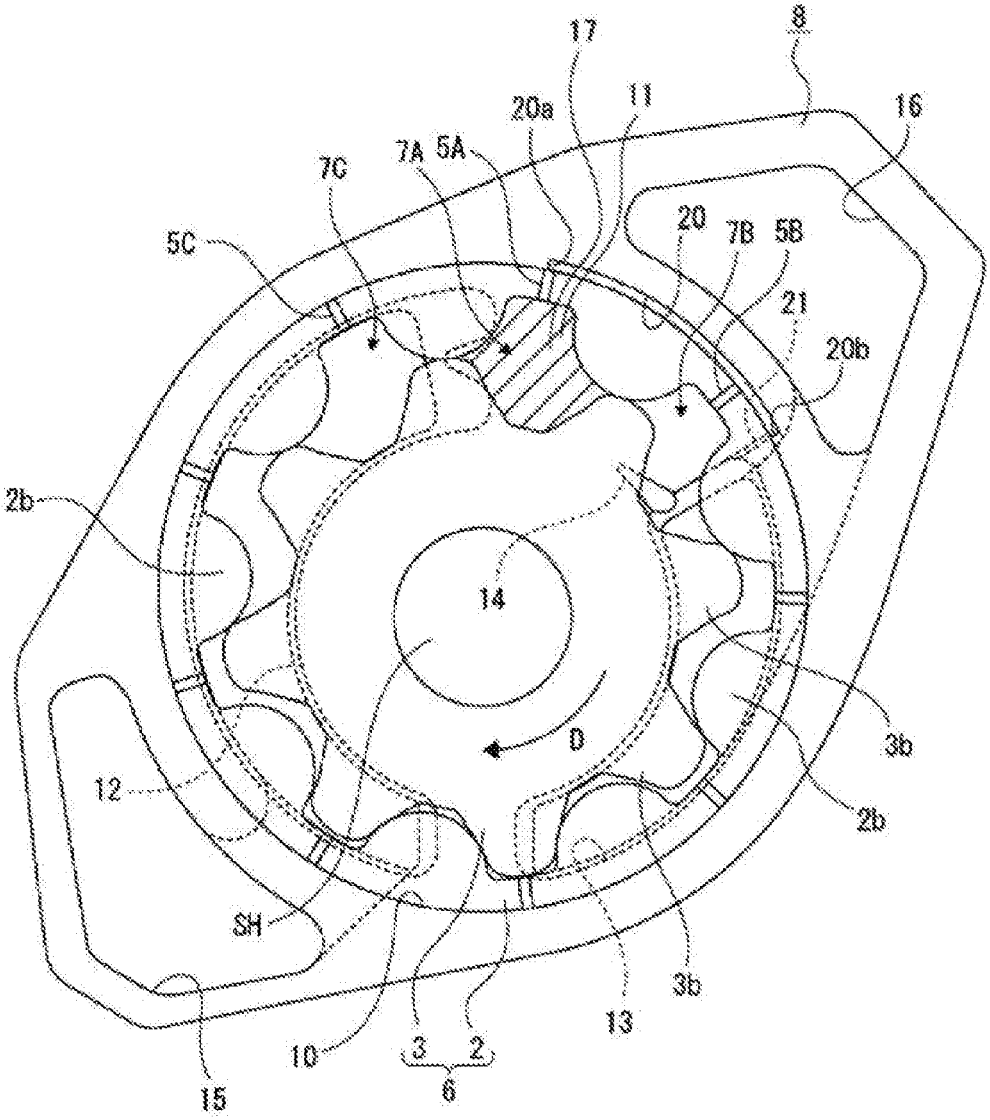
FIG. 8 is a top view of the rotor unit in the case for illustrating a movement of the pump chamber of interest.

Further rotating the pump shaft SH may bring the pump chamber 7A in the state illustrated in FIG. 6 out of communication with the inlet port 12, as illustrated in FIG. 8. FIG. 8 illustrates the pump chamber 7A out of communication with the inlet port 12 and at the completion of the suction operation. In the state illustrated in FIG. 8, the pump chamber 7A may be in communication with the case groove 20 via the rotor groove 5A.

In the process of the suction operation illustrated in FIGS. 5 and 6, the pump chamber 7A can take in air depending on an attitude or movement of the vehicle provided with the internal gear pump 1. Air flown together with oil into the pump chamber 7A in the process of the suction operation can be preferentially compressed in the pump chamber 7A while the pump chamber 7A is being reduced in volume in a subsequent contraction process. This can hinder the liquid or the oil from being sufficiently compressed.

The insufficiently compressed oil can be difficult to be discharged from the pump chamber 7A in the process of the discharging operation due to a low hydraulic pressure inside the pump chamber 7A. Moreover, a back-flow of the oil from the outlet port 13 to the pump chamber 7A can be caused because the outlet port 13 and the case-side outlet path 16 and the cover-side outlet path 24 that are provided downstream of the outlet port 13 have a higher pressure than the pump chamber 7A. This can increase the pressure pulsation.

In an example embodiment of the technology to address such a concern, the pump chamber 7A may be brought into communication with the case groove 20 holding the oil, after the suction operation, as illustrated in FIG. 8. When the pump chamber 7A has a low hydraulic pressure, the oil held in the case groove 20 may be flown into the pump chamber 7A via the rotor groove 5A to increase the hydraulic pressure of the pump chamber 7A. Additionally, air bubbles in the pump chamber 7A may be eliminated owing to the increase in the hydraulic pressure of the pump chamber 7A. This allows the pump chamber 7A to have an increased hydraulic pressure in a subsequent contraction process. Accordingly, it is possible to supply sufficient hydraulic pressure from the outlet port 13.

Figure 9:
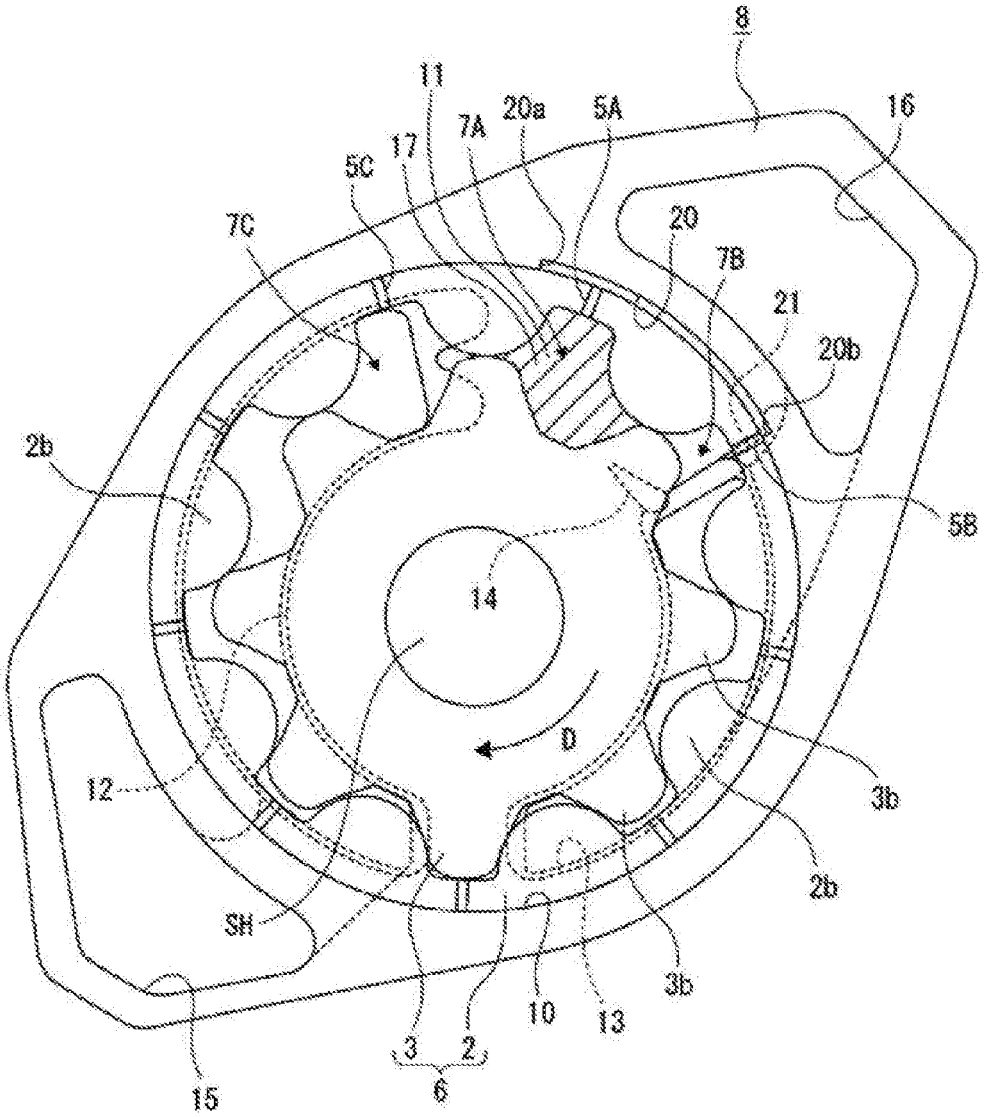
FIG. 9 is a top view of the rotor unit in the case for illustrating a movement of the pump chamber of interest.

Further rotating the pump shaft SH may bring the pump chamber 7A in the state illustrated in FIG. 8 into a state illustrated in FIG. 9. FIG. 9 illustrates the pump chamber 7A in the process of being reduced in volume. In other words, the pump chamber 7A may have a volume slightly smaller than its maximum volume in the state illustrated in FIG. 9.

In the state illustrated in FIG. 9, the rotor groove 5B and the joint groove 21 may be vertically aligned to form a single groove. Thus, the pump chamber 7B may be in communication with the case groove 20 via the single groove formed by the rotor groove 5B and the joint groove 21.

Figure 10:
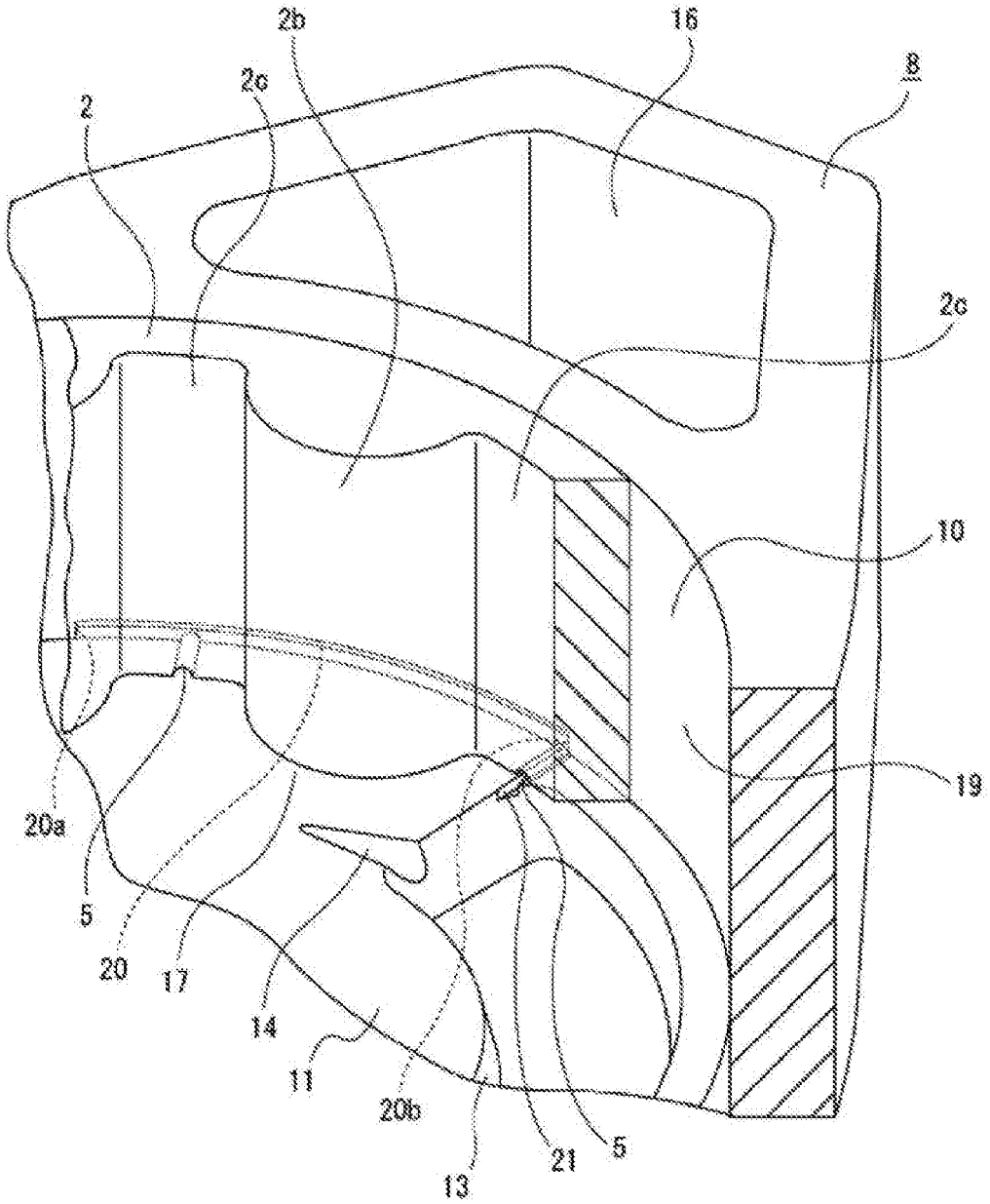
FIG. 10 is a perspective view of the case for illustrating a positional relation between the joint groove and the internal teeth.

In such a condition, a part of the joint groove 21 may define a recess that opens upward, as illustrated in FIG. 10. This configuration allows the oil to easily flow into the single groove formed by the rotor groove 5B and the joint groove 21 aligned with each other, facilitating oil supply to the case groove 20 having a reduced hydraulic pressure after the oil supply from the case groove 20 to the pump chamber 7A.

Figure 11:
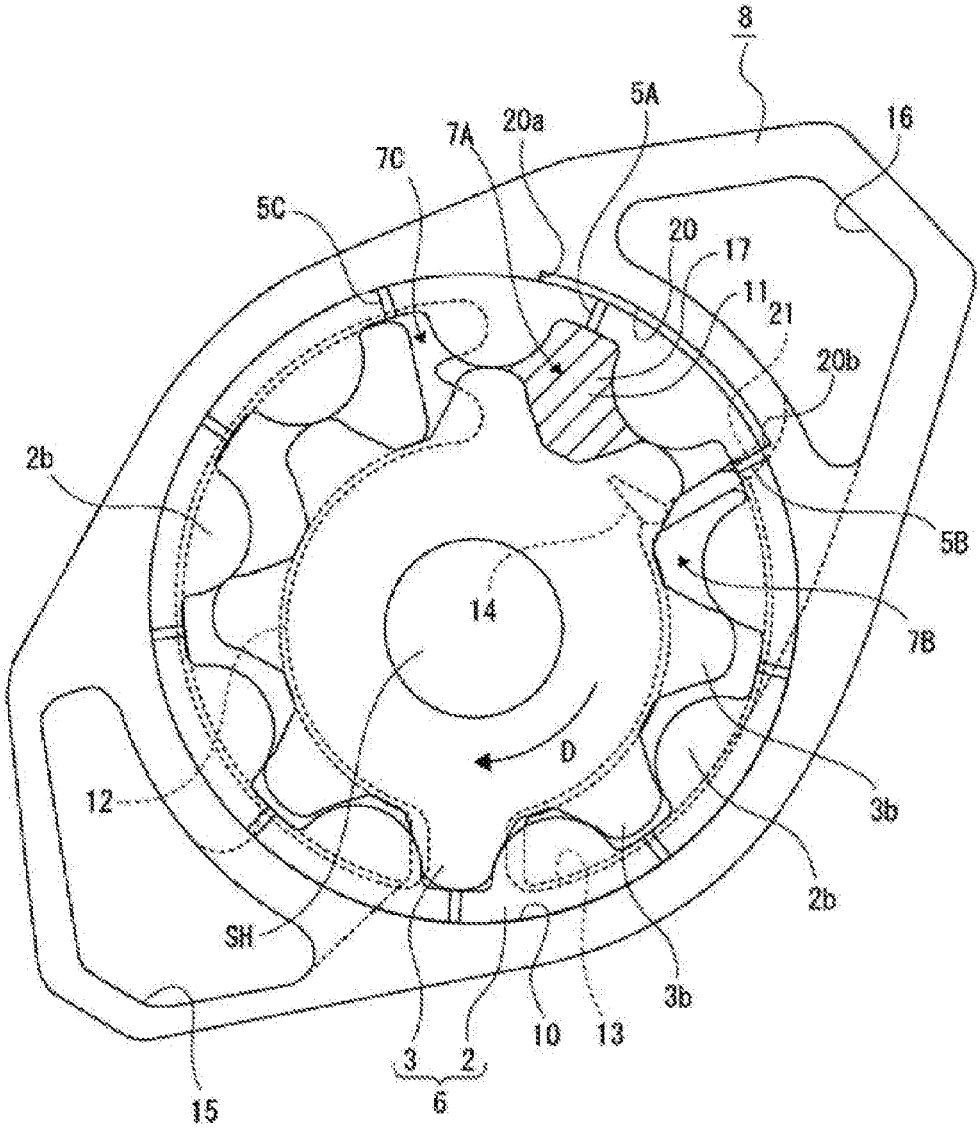
FIG. 11 is a top view of the rotor unit in the case for illustrating a movement of the pump chamber of interest.

Further rotating the pump shaft SH may bring the pump chamber 7A in the state illustrated in FIG. 9 into a state illustrated in FIG. 11. In the state illustrated in FIG. 11, the rotor groove 5B may be brought out of communication with the case groove 20, and thus substantially no oil may be flowing from the pump chamber 7B to the case groove 20. In such a condition, if the pump chamber 7A has a lower hydraulic pressure than the outlet port 13, a few amount of the oil may be flown from the outlet port 13 to the pump chamber 7A via the joint groove 21, the case groove 20, and the rotor groove 5A, to increase the low hydraulic pressure of the pump chamber 7A.

Figure 12:
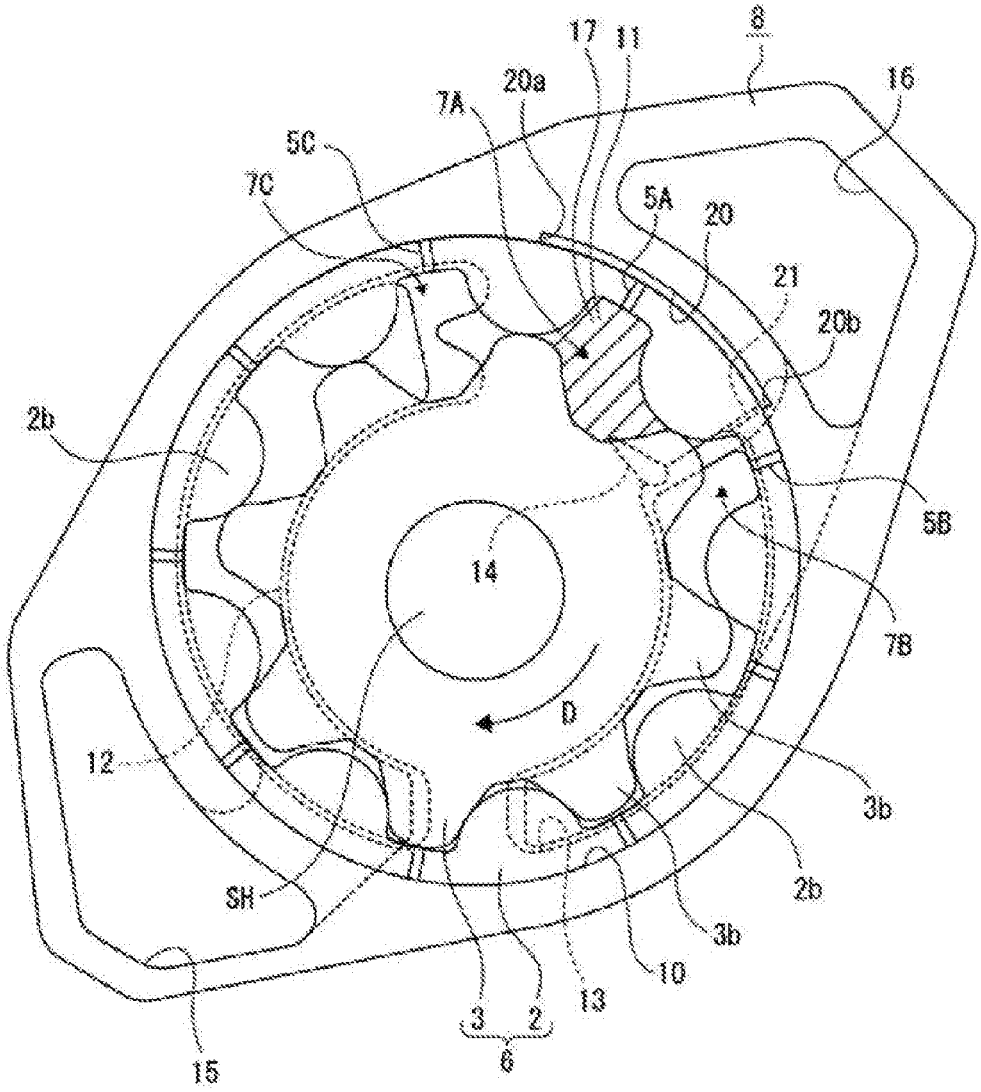
FIG. 12 is a top view of the rotor unit in the case for illustrating a movement of the pump chamber of interest.

Further rotating the pump shaft SH may bring the pump chamber 7A in the state illustrated in FIG. 11 into a state illustrated in FIG. 12. FIG. 12 illustrates the pump chamber 7A in communication with the outlet port 13 via the notch 14. That is, FIG. 12 illustrates the pump chamber 7A in the process of the discharging operation. Discharging the oil from the pump chamber 7A via the notch 14 before the pump chamber 7A is brought into communication with the outlet port 13 helps prevent the hydraulic pressure of the pump chamber 7A from being excessively increased.

Figure 13:
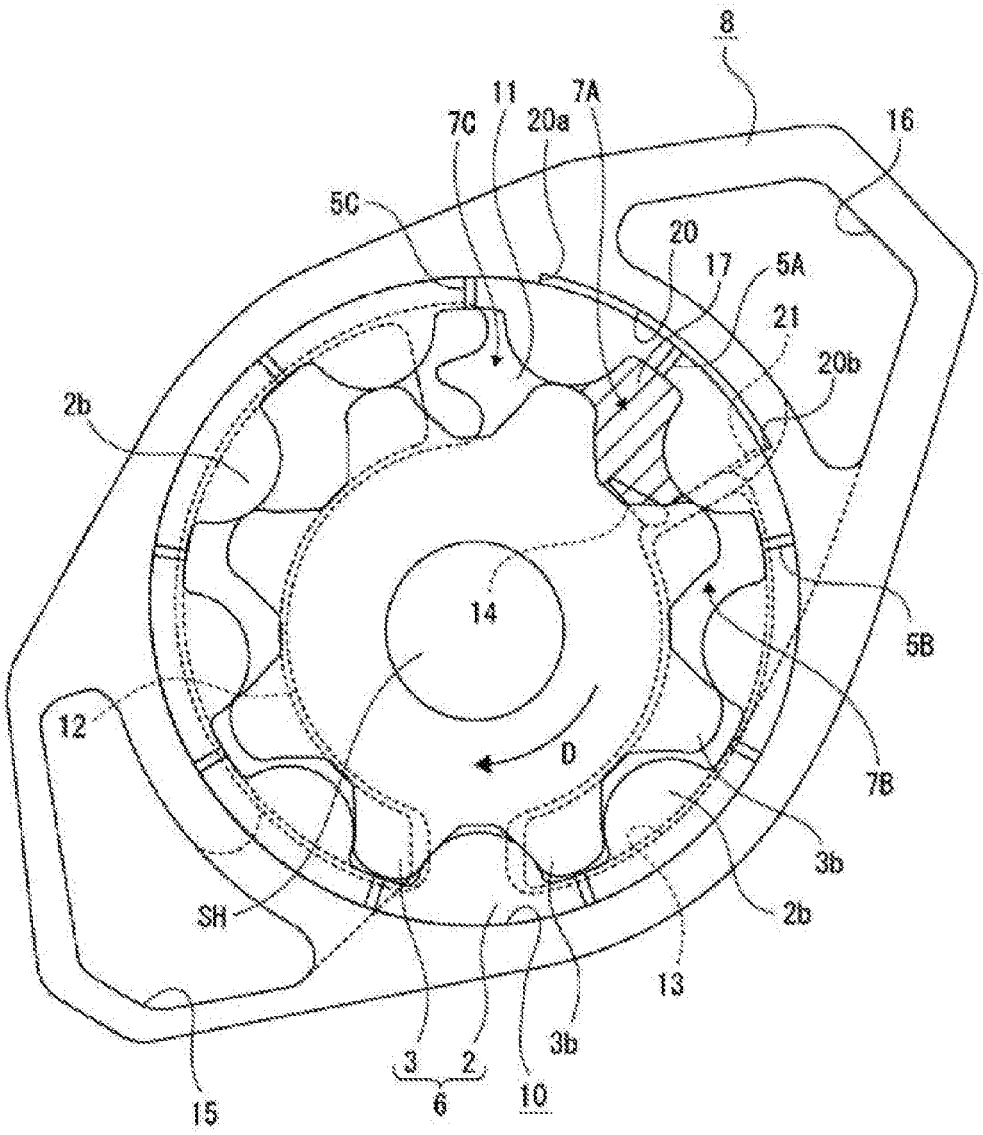
FIG. 13 is a top view of the rotor unit in the case for illustrating a movement of the pump chamber of interest.

Further rotating the pump shaft SH may bring the pump chamber 7A in the state illustrated in FIG. 12 into a state illustrated in FIG. 13. FIG. 13 illustrates the pump chamber 7A in direct communication with the outlet port 13. In the state illustrated in FIG. 13, the oil filled in the pump chamber 7A may be discharged to the outlet path via the notch 14 and the outlet port 13 in association with the reduction in volume of the pump chamber 7A. In the state illustrated in FIG. 13, the top opening of the joint groove 21 may be closed with the internal tooth 2*b*, which makes the oil difficult to be flown from the outlet port 13 to the case groove 20.

Figure 14:
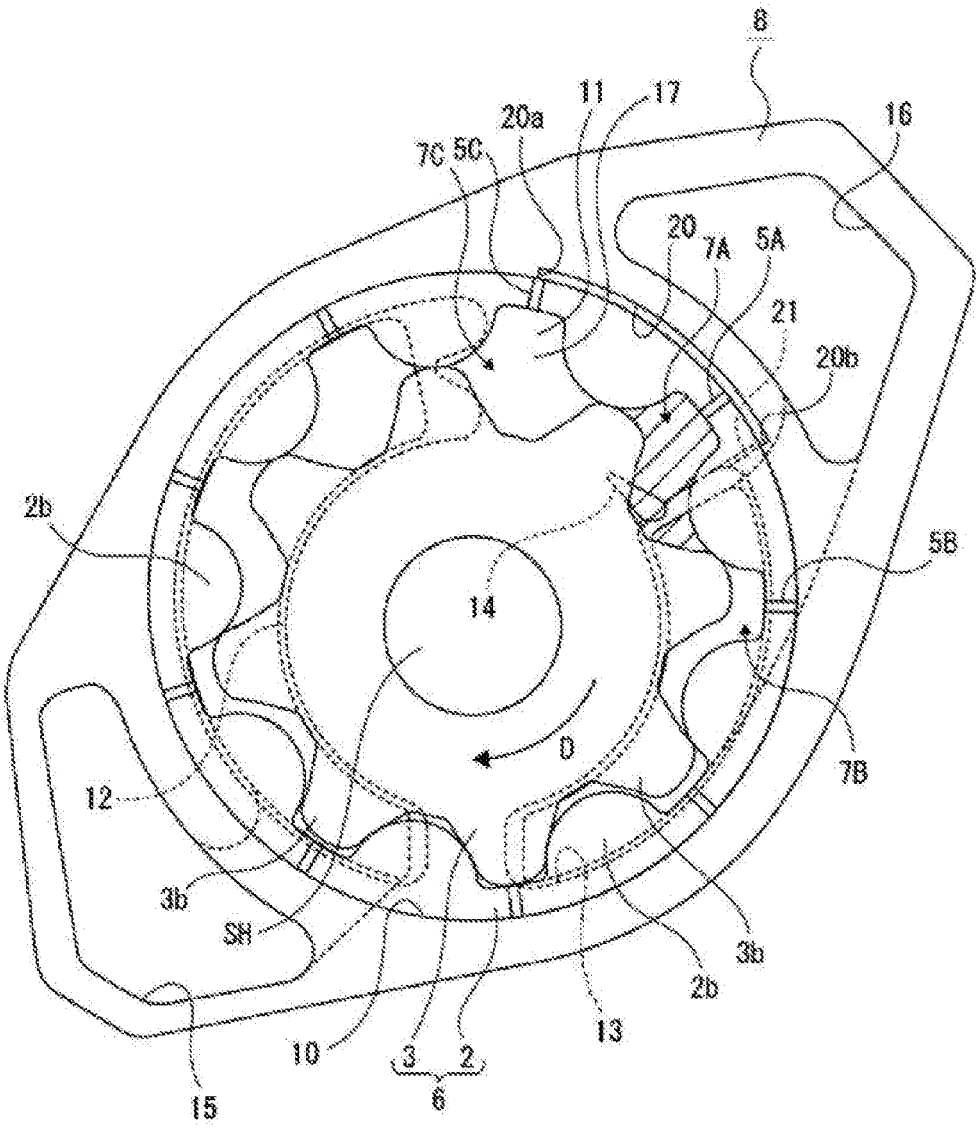
FIG. 14 is a top view of the rotor unit in the case for illustrating a movement of the pump chamber of interest.

Further rotating the pump shaft SH may bring the pump chamber 7A in the state illustrated in FIG. 13 into a state illustrated in FIG. 14. In the state illustrated in FIG. 14, the pump chamber 7A may be in the process of the discharging operation, and the pump chamber 7C behind the pump chamber 7A may be at the end of the suction operation. When the amount of the oil in the pump chamber 7C is small, i.e., when air is taken into the pump chamber 7C, the oil held in the case groove 20 may be flown into the pump chamber 7C via the rotor groove 5C to increase the low hydraulic pressure of the pump chamber 7C.

The pressure inside the case groove 20 may decrease as the hydraulic pressure of the pump chamber 7C increases. Thus, the oil may be flown from the pump chamber 7A to the case groove 20 via the rotor groove 5A, and from the outlet port 13 to the case groove 20 via the joint groove 21.

Figure 15:
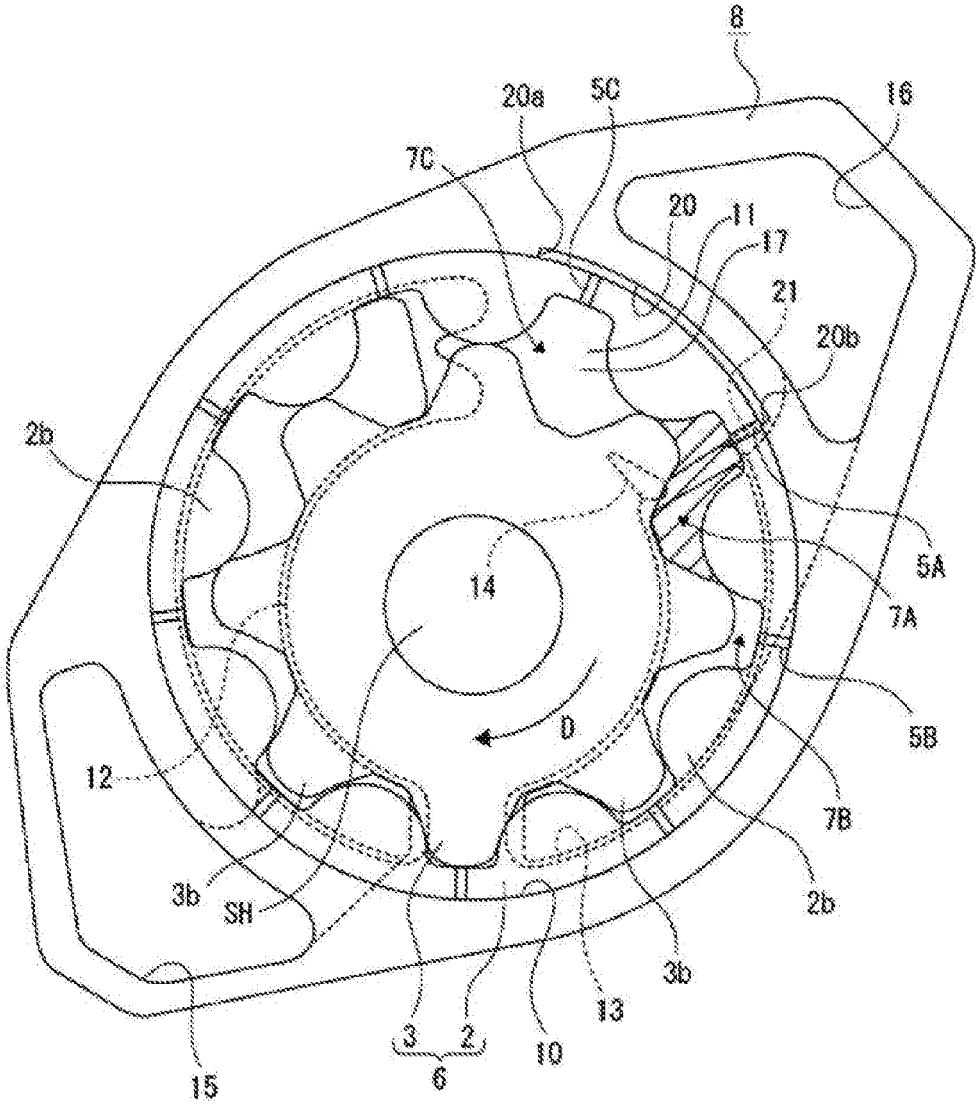
FIG. 15 is a top view of the rotor unit in the case for illustrating a movement of the pump chamber of interest.

Further rotating the pump shaft SH may bring the pump chamber 7A in the state illustrated in FIG. 14 into a state illustrated in FIG. 15. In the state illustrated in FIG. 15, the rotor groove 5A and the joint groove 21 may be vertically aligned to form a single groove. In such a condition, a part of the joint groove 21 may define a recess that opens upward because the internal tooth 2*b* of the outer rotor 2 is not located above the joint groove 21. This configuration allows the oil to flow from the outlet port 13 to the case groove 20 via the single groove formed by the rotor groove 5A and the joint groove 21 aligned with each other. In this way, the oil may be flown in the case groove 20 having a reduced hydraulic pressure.

As illustrated in FIGS. 5 to 15, the oil may be flown into and held in the case groove 20 because the outer rotor 2 and the inner rotor 3 are rotated in accordance with rotation of the pump shaft SH. The oil held in the case groove 20 may be supplied to any of the pump chambers 7 having a reduced hydraulic pressure and thus possibly causing a back-flow of the oil from the outlet port 13. This suppresses a back-flow of the oil from the outlet port 13 to the pump chamber 7 and an increase in pressure pulsation.

Note that the oil leaking from a slight clearance between the outer rotor 2 and the holding recess 10 may also be received into the case groove 20. Thus, the oil leaking in the process of the suction or discharging operation may be held in the case groove 20 without wasting the oil. Accordingly, even if the pump chamber has a low hydraulic pressure after the suction operation, it is possible to effectively return the pump chamber 7 from the low hydraulic pressure to a normal hydraulic pressure by supplying the oil to the pump chamber 7.

3. CONCLUSION

As described above, the internal gear pump 1 includes the outer rotor 2, the inner rotor 3, and the pump housing 4. The outer rotor 2 has the internal teeth 2*b*. The inner rotor 3 is rotatably disposed inside the outer rotor 2 and has the external teeth 3*b* engaging with the internal teeth 2*b*. The external teeth 3*b* are less in number by one than the internal teeth 2*b*. The inner rotor 3 and the outer rotor 2 define the pump chambers 7 (7A, 7B, and 7C) therebetween. The pump chambers 7 are configured to alternately repeat expansion and contraction. The pump housing includes: the holding recess 10 rotatably holding the outer rotor 2 and having a wall on which the outer peripheral face of the outer rotor 2 is to slide; the inlet (inlet port 12) configured to take in a fluid into the pump chambers 7; the outlet (outlet port 13) configured to discharge the fluid from the pump chambers 7; the case groove 20 provided on the wall (the inner peripheral face 19) and configured to hold the fluid; and the joint groove 21 provided on the upper land face 17 that is defined between the trailing end 12*b* of the inlet and the leading end 13*a* of the outlet and on which the internal teeth 2*b* and the external teeth 3*b* are to slide. The joint groove 21 joins the outlet and the case groove 20. The outer rotor 2 further has the rotor grooves 5 (5A, 5B, and 5C) configured to join the respective pump chambers 7 to the case groove 20. Because the outlet port 13 is in communication with the case groove 20 via the joint groove 21, a part of the oil discharged to the outlet port 13 may be flown into the case groove 20. The oil held in the case groove 20 may be flown to the pump chamber 7 via the rotor groove 5. In this way, the oil may be supplied to the pump chamber 7 having a low hydraulic pressure due to the presence of the air in the pump chamber 7, to increase the low hydraulic pressure of the pump chamber 7. This helps prevent the pump chamber 7 from being in a negative pressure state, suppressing a back-flow of the oil from the outlet port 13 to the pump chamber 7. Preventing the pump chamber 7 from being in the negative pressure state suppresses generation of air bubbles and, in turn, the occurrence of erosion.

In the internal gear pump 1 according to some example embodiments of the technology, the case groove 20 may be provided such that the pump chamber 7 is brought into communication with the case groove 20 after being brought out of communication with the inlet (inlet port 12). For example, the case groove 20 may be provided such that the leading end 20*a* of the case groove 20 does not reach the rotor groove 5 radially extending from the pump chamber 7 in communication with the inlet port 12. This configuration helps prevent the inlet port 12 and the outlet port 13 from being brought into communication with each other via the rotor groove 5 and the case groove 20.

In the internal gear pump 1 according to some example embodiments of the technology, the trailing end 20*b* of the case groove 20 and the leading end 13*a* of the outlet (outlet port 13) may be aligned on an identical radial line of the outer rotor 2. In this case, the case groove 20 may be provided so as not to reach a side of the outlet port 13. Thus, no path may be provided through which the oil is actively flown from the pump chamber 7 to the joint groove 21 after the middle of the discharging operation. This helps prevent the discharge pressure from being excessively decreased.

In the internal gear pump 1 according to some example embodiments of the technology, the joint groove 21 may extend from the leading end 13*a* of the outlet (outlet port 13) towards the wall (inner peripheral face 19). This configuration helps prevent the rotor groove 5 radially extending from the pump chamber 7 from being brought into communication with (jointed to) the joint groove 21 and forming a large-size groove while the pump chamber 7 is located in a region between a middle of the outlet port 13 and the trailing end 13*b* of the outlet port 13. This, in turn, helps prevent the discharge pressure from decreasing between the middle of the discharging operation and the end of the discharging operation.

In the internal gear pump 1 according to some example embodiments of the technology, the rotor groove 5 may extend in the radial direction of the outer rotor 2. For example, the rotor groove 5 may be provided so as to extend along a straight line radially extending from the center of the outer rotor 2. This helps prevent the inlet port 12 and the outlet port 13 from being brought into communication with each other via the rotor groove 5 on the lower land face 18, for example.

According to at least one embodiment of the technology, the pump housing has a joint groove provided at the outlet, and a case groove provided on the wall on which the outer peripheral face of the outer rotor is to slide. When the joint groove is brought into communication with the case groove, a part of the oil discharged to the outlet may be flown into and held in the case groove. Accordingly, it is possible to provide the internal gear pump that suppresses a back-flow of oil from the outlet port to the pump chamber in a case where air bubbles are taken into the pump chamber, and thereby reduces the pressure pulsation.

It should be appreciated that the foregoing example embodiments of the technology described merely illustrative and non-limiting and are not intended to limit the scope of the technology. It should be also appreciated that various omissions, replacements, and modifications may be made in the foregoing example embodiments described herein, without departing from the scope of the technology. The technology is intended to include such modifications and alterations in so far as they fall within the scope of the appended claims or the equivalents thereof.

The invention claimed is:

1. An internal gear pump comprising:

an outer rotor having internal teeth;

an inner rotor rotatably disposed inside the outer rotor and having external teeth engaging with the internal teeth, the external teeth being less in number by one than the internal teeth, the inner rotor and the outer rotor defining a plurality of pump chambers therebetween, the pump chambers being configured to alternately repeat expansion and contraction; and a pump housing including a holding recess rotatably holding the outer rotor and having a cylindrical wall on which an outer peripheral face of the outer rotor is to slide, an inlet configured to take in a fluid into the pump chambers, an outlet configured to discharge the fluid from the pump chambers, a case groove provided on the cylindrical wall and configured to hold the fluid, and a joint groove provided on an upper land face that is defined between a trailing end of the inlet and a leading end of the outlet and on which the internal teeth and the external teeth are to slide, the joint groove joining the outlet and the case groove, wherein the outer rotor further has rotor grooves configured to join the respective pump chambers to the case groove.

2. The internal gear pump according to claim 1, wherein the rotor grooves extend in a radial direction of the outer rotor.

3. The internal gear pump according to claim 1, wherein the joint groove extends from the leading end of the outlet toward the cylindrical wall.

4. The internal gear pump according to claim 3, wherein the rotor grooves extend in a radial direction of the outer rotor.

5. The internal gear pump according to claim 1, wherein a trailing end of the case groove and the leading end of the outlet are aligned on an identical radial line of the outer rotor.

6. The internal gear pump according to claim 5, wherein the rotor grooves extend in a radial direction of the outer rotor.

7. The internal gear pump according to claim 5, wherein the joint groove extends from the leading end of the outlet toward the cylindrical wall.

8. The internal gear pump according to claim 7, wherein the rotor grooves extend in a radial direction of the outer rotor.

9. The internal gear pump according to claim 1, wherein the case groove is configured to be brought into communication with any of the pump chambers having been brought out of communication with the inlet.

10. The internal gear pump according to claim 9, wherein the rotor grooves extend in a radial direction of the outer rotor.

11. The internal gear pump according to claim 9, wherein a trailing end of the case groove and the leading end of the outlet are aligned on an identical radial line of the outer rotor.

12. The internal gear pump according to claim 11, wherein the rotor grooves extend in a radial direction of the outer rotor.

13. The internal gear pump according to claim 9, wherein the joint groove extends from the leading end of the outlet toward the cylindrical wall.

14. The internal gear pump according to claim 13, wherein the rotor grooves extend in a radial direction of the outer rotor.

15. An internal gear pump comprising:

an outer rotor having internal teeth;

an inner rotor rotatably disposed inside the outer rotor and having external teeth engaging with the internal teeth, the external teeth being less in number by one than the internal teeth, the inner rotor and the outer rotor defining a plurality of pump chambers therebetween, the pump chambers being configured to alternately repeat expansion and contraction; and a pump housing including a holding recess rotatably holding the outer rotor and having a cylindrical wall on which an outer peripheral face of the outer rotor is to slide, an inlet configured to take in a fluid into the pump chambers, an outlet configured to discharge the fluid from the pump chambers, a case groove provided on the wall and configured to hold the fluid, and a joint groove provided on an upper land face that is defined between a trailing end of the inlet and a leading end of the outlet and on which the internal teeth and the external teeth are to slide, the joint groove joining the outlet and the case groove, wherein the outer rotor further has rotor grooves configured to join the respective pump chambers to the case groove, and wherein the joint groove extends from the leading end of the outlet toward the wall.

16. The internal gear pump according to claim 15, wherein the rotor grooves extend in a radial direction of the outer rotor.

17. An internal gear pump comprising:

an outer rotor having internal teeth;

an inner rotor rotatably disposed inside the outer rotor and having external teeth engaging with the internal teeth, the external teeth being less in number by one than the internal teeth, the inner rotor and the outer rotor defining a plurality of pump chambers therebetween, the pump chambers being configured to alternately repeat expansion and contraction; and a pump housing including a holding recess rotatably holding the outer rotor and having a wall on which an outer peripheral face of the outer rotor is to slide, an inlet configured to take in a fluid into the pump chambers, an outlet configured to discharge the fluid from the pump chambers, a case groove provided on the wall and configured to hold the fluid, and a joint groove provided on an upper land face that is defined between a trailing end of the inlet and a leading end of the outlet and on which the internal teeth and the external teeth are to slide, the joint groove joining the outlet and the case groove, wherein the outer rotor further has rotor grooves provided on a bottom face of the outer rotor and configured to join the respective pump chambers to the case groove, the bottom face of the outer rotor slides with the upper land face.

18. The internal gear pump according to claim 17, wherein the rotor grooves extend in a radial direction of the outer rotor.

19. The internal gear pump according to claim 17, wherein the wall has a cylindrical shape, wherein the case groove provided at a corner defined by the upper land face and the wall joined to each other.

20. The internal gear pump according to claim 19, wherein the rotor grooves extend in a radial direction of the outer rotor.

* * * * *